United States Patent [19]

Chun

[11] 4,010,639

[45] Mar. 8, 1977

[54] MULTI PURPOSE TORQUE WRENCH

[75] Inventor: Delo Kwai Kum Chun, Mission Viejo, Calif.

[73] Assignee: Ingersoll-Rand Company, Woodcliff Lake, N.J.

[22] Filed: Dec. 17, 1975

[21] Appl. No.: 641,569

[52] U.S. Cl. ..... 73/139; 116/129 T; 350/113

[51] Int. Cl.[2] ..... B25B 23/14

[58] Field of Search ..... 73/139, 1 C; 116/129 R, 116/129 K, 129 T, 129 F; 350/113, 297; D10/102, 122, 123, 124

[56] References Cited

UNITED STATES PATENTS

| | | | |
|---|---|---|---|
| 1,033,420 | 7/1912 | Kuch | 350/113 |
| 1,388,292 | 8/1921 | Noisom | 350/113 |
| 2,269,503 | 1/1942 | Zimmerman | 73/139 |
| 2,283,888 | 5/1942 | Zimmerman | 73/139 |
| 3,782,524 | 1/1974 | Zembaty | 350/113 |

*Primary Examiner*—Charles A. Ruehl
*Attorney, Agent, or Firm*—Walter C. Vliet

[57] ABSTRACT

A torque wrench is disclosed which may be utilized in conventional or overhead applications without need for the operator to assume awkward positions to read the torque output. An adjustable mirror arrangement with a unique dial face allows the operator to constantly view the torque readout in erect numerals while in the most convenient torque applying position.

2 Claims, 3 Drawing Figures

MULTI PURPOSE TORQUE WRENCH

BACKGROUND AND SUMMARY OF THE INVENTION

The need for a torque wrench which can be easily read by the operator while he is in the most convenient torque applying position is well known. To date, the solution to this requirement has been a complicated or expensive approach to remote reading dials or in the alternative release or signal wrenches. The need for a simple, rugged, and reliable method of torque wrench dial reading is disclosed in my invention. My invention will fill the need for a torque wrench which may be utilized in both the conventional downward or the overhead position with relatively equal ease.

The object of the invention is to provide a means for reading the torque indicating device of a conventional torque wrench from any convenient operator position. It is a further object of this invention to provide a readout means which can form an integral part of the wrench. It is an object to provide a readout device which is simple and economical to manufacture and rugged and reliable in use having a minimum of parts. These and other objects are met in a torque wrench for off-position use comprising: A wrench means for rotating a fastener; a calibrated means operatively associated with the wrench for measuring the torque required to rotate the fastener; a mirror means mounted on the wrench for reading the calibrated means; and mirror image scale means associated with the calibrated means for facilitating the reading of measured torque.

DESCRIPTION OF THE PREFERRED EMBODIMENT

Figure 1:
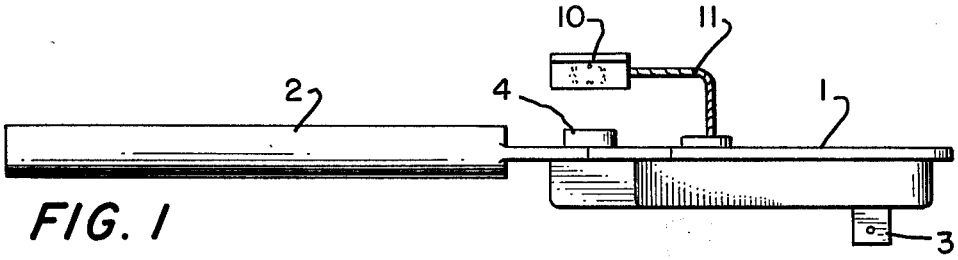
FIG. 1 is a perspective view of the torque wrench of this invention.
Figure 2:
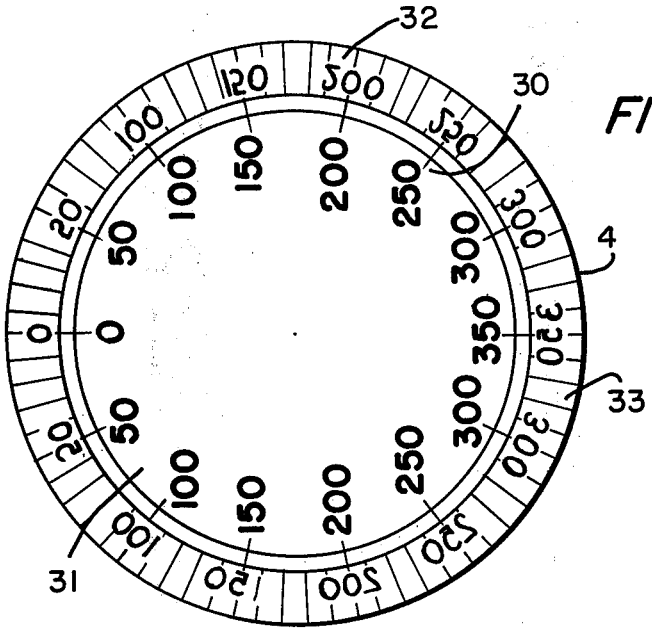
FIG. 2 is a plan view of the dial face utilized with the present invention.

In FIG. 1, a conventional dial torque wrench 1 is shown having a handle 2, a square output shank 3, and a torque indicating dial face 4. Mounted on the body of the dial torque wrench is a viewing mirror 10 which is adjustably secured to the wrench body by means of an adjustable arm 11. FIG. 2 shows a dial face 4 which is to be utilized with a pointer indicator (not shown). The dial is provided with four separate scales, two scales are conventional and are to be utilized in standard torque wrench use and read torque in either clockwise or counterclockwise directions.

A convenient scale of 0 to 350 foot pound is shown for illustration purposes. It should be obvious to one skilled in the art that scales 30 and 31 have conventional numbers and may be utilized for reading torques from 0 to 350 foot pound in both clockwise and counterclockwise directions. Scales 32 and 33 are printed with mirror-imaged numerals and are used according to the present invention as follows: Scale 30 and 31 are viewed directly by the operator as he uses the torque wrench in the conventional manner.

In areas of limited access or where the torque wrench is to be utilized in an inverted position, the viewing mirror 10 is adjusted so that the operator can view the dial image reflected in the mirror. The wrench is then utilized in the inverted manner while reading the scales 32 or 33 depending on whether the torque is applied in a clockwise or a counterclockwise manner.

Figure 3:
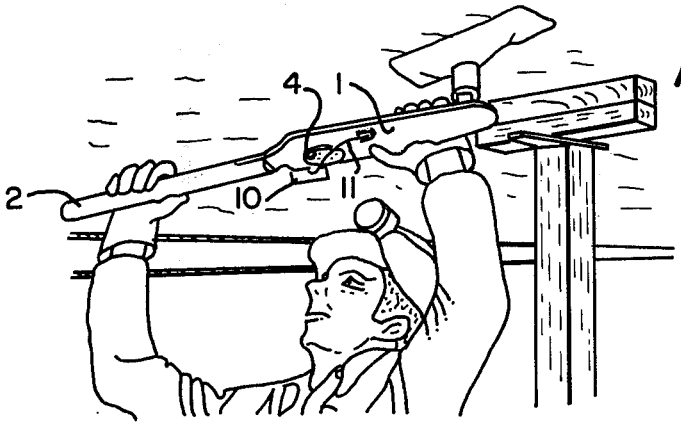
FIG. 3 is a pictorial drawing of the invention in use in the inverted position.

FIG. 3 shows the method of operation in an inverted position for use in torquing mine roof bolts to exacting safety standards. As can be seen in this example, without my invention, the operator would be required to view numbers in an awkward, overhead position. Using the present invention and viewing the mirror-imaged numerals, the operator can comfortably read the output torque from his most convenient position for applying that torque.

Several alternative methods of mounting the mirror present themselves and the particular form of dial face utilized may be varied to suit the particular form of conventional dial torque wrench or other types of torque wrenches with readable scales. I do not wish to be limited in the scope of my invention except by the claims.

I claim:

1. A torque wrench for off position use comprising:

a wrench for rotating a fastener;

a calibrated dial operatively associated with the wrench for measuring the torque required to rotate the fastener;

an adjustably mounted mirror mounted on said wrench for reading said calibrated dial; and a mirror image scale in combination with a conventional image scale on said calibrated dial for facilitating the reading of measured torque in any use position.

2. The torque wrench of claim 1 wherein:

said mirror image scale is inscribed adjacent to said conventional scale in concentric relationship for easy scale identification.

* * * * *